US006988966B1

(12) United States Patent
Guzman

(10) Patent No.: US 6,988,966 B1
(45) Date of Patent: Jan. 24, 2006

(54) METHOD FOR CONTROLLING A BATTER'S FOOT

(76) Inventor: Daniel P. Guzman, 278 N. Hemlock, Wood Dale, IL (US) 60191

( * ) Notice: Subject to any disclaimer, the term of this patent is extended or adjusted under 35 U.S.C. 154(b) by 24 days.

(21) Appl. No.: 10/861,629

(22) Filed: Jun. 7, 2004

(51) Int. Cl.
*A63B 69/00* (2006.01)

(52) U.S. Cl. ..... 473/452; 473/422

(58) Field of Classification Search ..... 473/422, 473/452, 217, 458, 266, 270, 450, 464
See application file for complete search history.

(56) References Cited

U.S. PATENT DOCUMENTS

| | | | | |
|---|---|---|---|---|
| 3,372,930 | A * | 3/1968 | Sertich | 473/452 |
| 3,466,040 | A * | 9/1969 | Sertich | 473/452 |
| 3,606,341 | A * | 9/1971 | Honbarger | 473/217 |
| 4,194,735 | A * | 3/1980 | Wilson | 473/452 |
| 4,516,772 | A | 5/1985 | Stratton | |
| 4,757,995 | A * | 7/1988 | Gallagher | 473/458 |
| 5,029,869 | A * | 7/1991 | Veasey | 473/217 |
| 5,062,643 | A | 11/1991 | Bibbey et al. | |
| 5,076,580 | A | 12/1991 | Lang | |
| 5,318,290 | A * | 6/1994 | Sawyer | 473/217 |
| 6,432,001 | B1 | 8/2002 | Pierce | |
| D476,052 | S | 6/2003 | Barth et al. | |
| D477,376 | S | 7/2003 | O'Dell et al. | |
| 6,638,176 | B1 * | 10/2003 | Hayes et al. | 473/266 |
| 2003/0130072 | A1 | 7/2003 | Barth et al. | |

* cited by examiner

*Primary Examiner*—Mitra Aryanpour

(57) ABSTRACT

A method for controlling a batter's foot includes a flexible panel that has a front edge, a back edge, a first side edge and a second side edge. The front edge has an arcuate notch therein. The panel has a pair of apertures extending therethrough. Each of a pair of reinforcement rings is attached to a peripheral edge of one of the openings. Each one of pair of elongated rods has a first end and a second end. The first ends are pointed. Each of a pair of handles is attached to one of the second ends. The rods are each extended through one of the rings. A rear foot of a batter is positioned beneath the panel such that the ankle of the rear foot is positioned in the notch. The first ends of the rods are extended into a ground surface to restrict lifting of the rear foot.

9 Claims, 3 Drawing Sheets

METHOD FOR CONTROLLING A BATTER'S FOOT

BACKGROUND OF THE INVENTION

1. Field of the Invention

The present invention relates to batting technique teaching devices and more particularly pertains to a new batting technique teaching device for teaching a baseball batter proper foot movement or restraint thereof.

2. Description of the Prior Art

The use of batting technique teaching devices is known in the prior art. U.S. Pat. No. 5,062,643 shows an analogous device used for golfing which provides a shoe device that that golfer steps into with their forward foot. The shoe is staked to the ground to prevent improper rotation of the forward foot. Another type of batting technique teaching device is U.S. Patent No. Application 2003/0130072 A1 that describes a device for limiting the stride of a forward foot of a batter to keep the batter's weight properly balanced during a swing. Yet another such device is U.S. Pat. No. 4,516,772 that again aids a batter in practicing proper striding of their front foot while swinging a bat.

While these devices fulfill their respective, particular objectives and requirements, the need remains for a device that is adapted for retaining the rear foot of a batter in a planted position through a swing. Such device would keep a batter more stable through the swing and would prevent unnecessary movement within a batter's box. These features would improve the batting average and the overall technique of the batter by "quieting" their body movements.

SUMMARY OF THE INVENTION

The present invention meets the needs presented above by comprising a flexible panel has a top side, a bottom side and a peripheral edge, the peripheral edge including a front edge, a back edge, a first side edge and a second side edge. The front edge has an arcuate notch therein that is substantially centered between the first and second side edges. The panel has a pair of apertures extending therethrough. Each of the apertures is positioned generally adjacent to one of the first and second side edges and between the front and back edges. Each of a pair of reinforcement rings is attached to a peripheral edge of one of the openings. A pair of elongated rods is provided that each has a first end and a second end, wherein the first ends are pointed. Each of a pair of handles is attached to one of the second ends of the rods. The rods are each extended through one of the rings such that each of the first ends of the rods extends away from the bottom side of the panel. A rear foot of a batter is positioned beneath the panel such that the ankle of the rear foot is positioned in the notch. The first ends of the rods are extended into a ground surface so that lifting of the rear foot from the ground surface is restricted when the batter swings at a pitch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
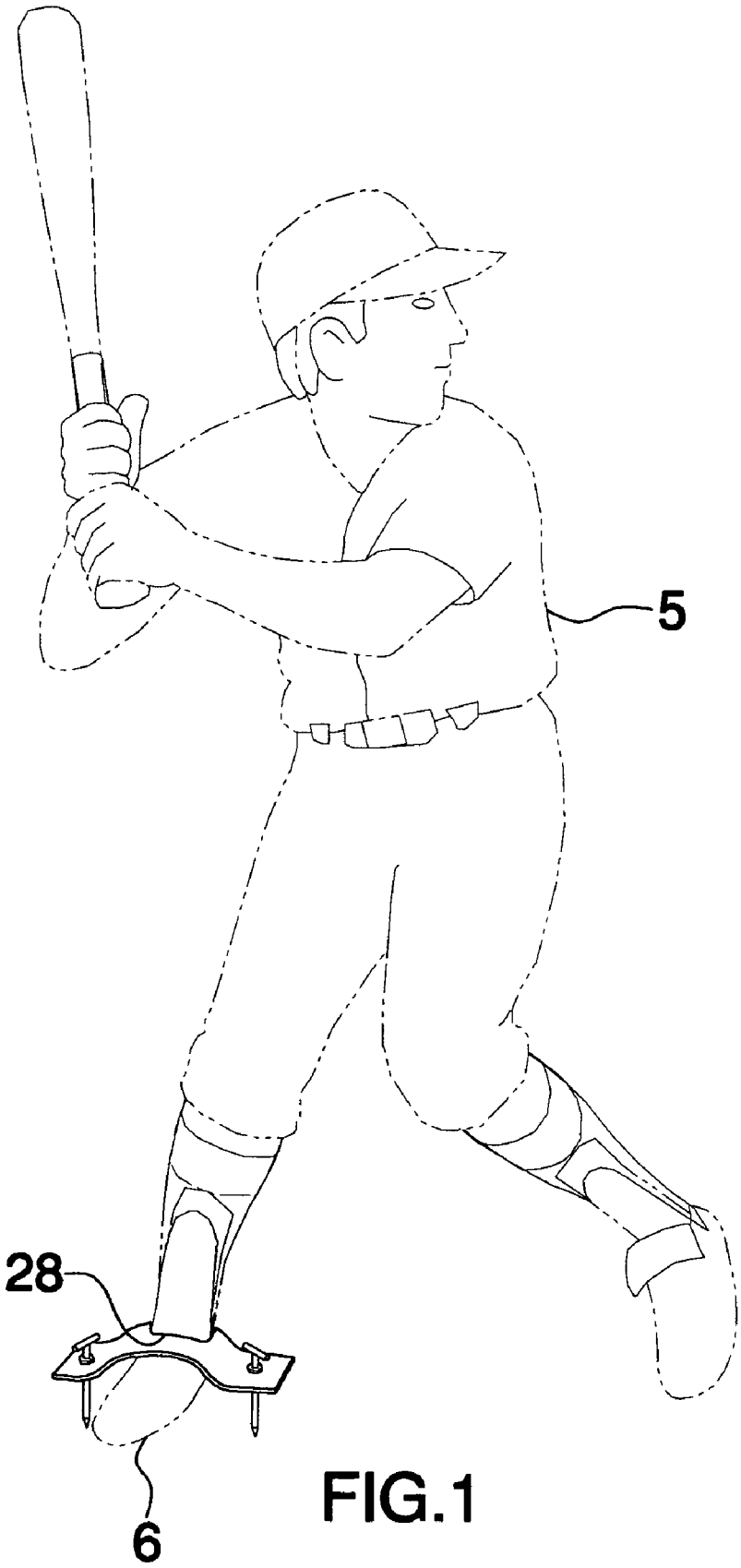
FIG. 1 is a perspective in-use view of a method for controlling a batter's foot according to the present invention.
Figure 2:
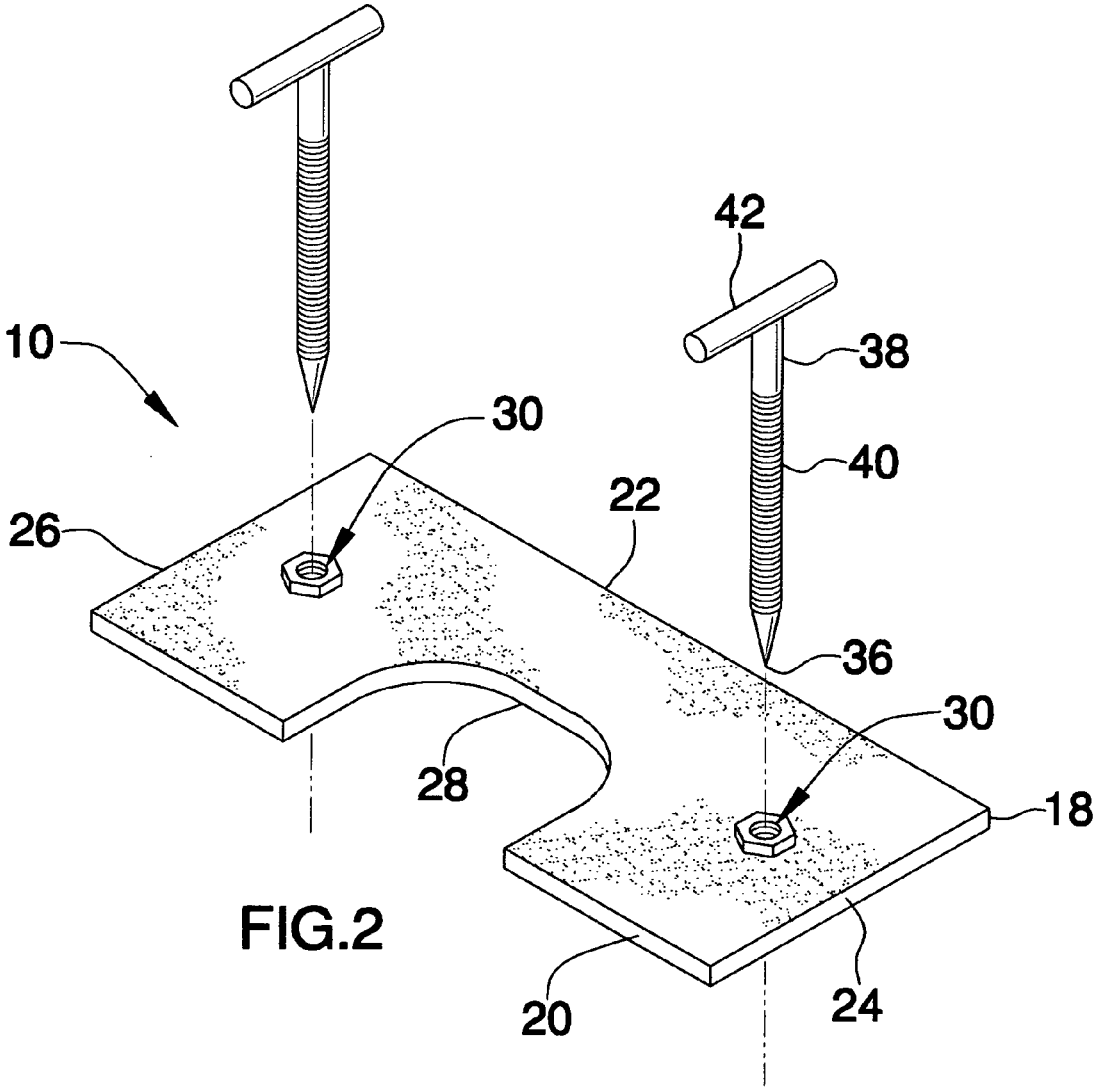
FIG. 2 is a perspective view of the present invention.
Figure 3:
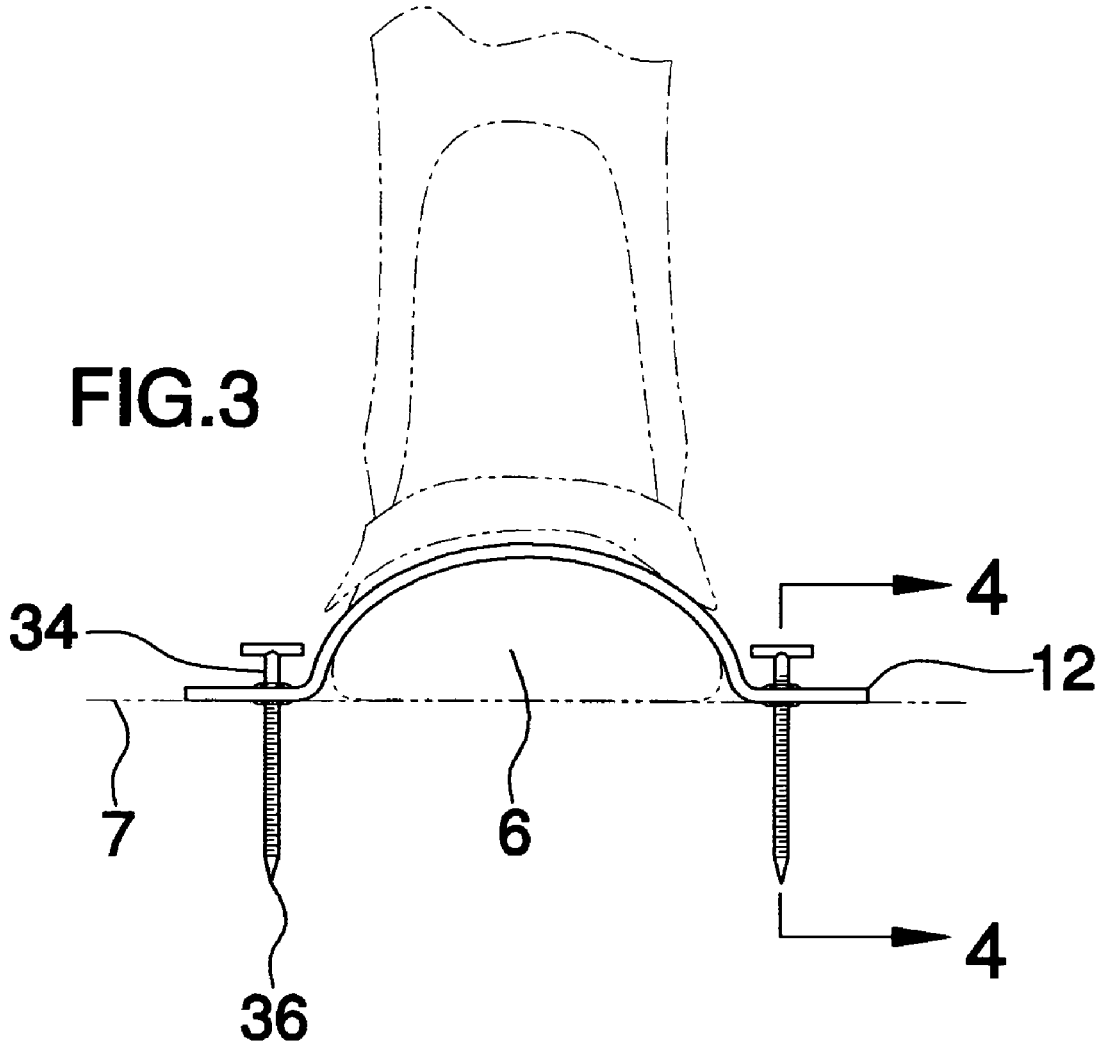
FIG. 3 is a front view of the present invention.
Figure 4:
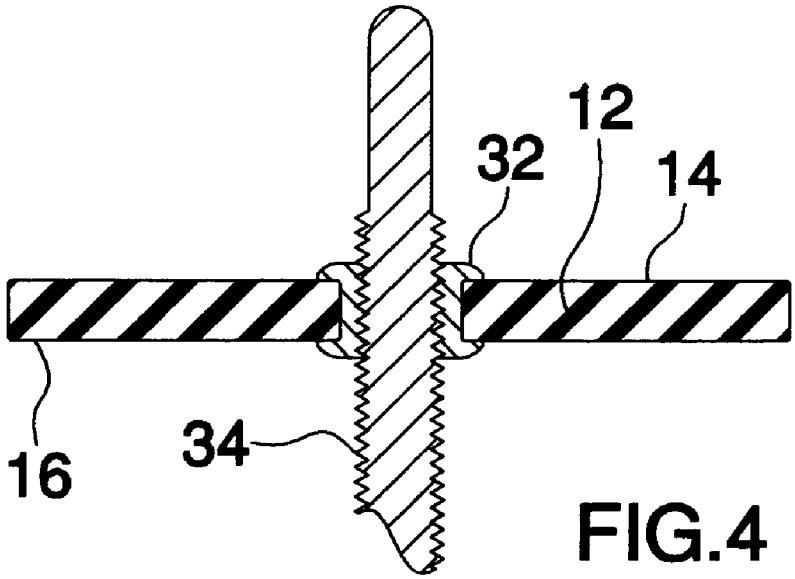
FIG. 4 is a cross-sectional view taken along line 4—4 of FIG. 3 of the present invention.

With reference now to the drawings, and in particular to FIGS. 1 through 4 thereof, a new batting technique teaching device embodying the principles and concepts of the present invention and generally designated by the reference numeral 10 will be described.

As best illustrated in FIGS. 1 through 4, the device 10 and method for controlling a batter's foot generally includes providing a flexible panel 12 that has a top side 14, a bottom side 16 and a peripheral edge 18. The peripheral edge 18 includes a front edge 20, a back edge 22, a first side edge 24 and a second side edge 26. The panel 12 has a width from the first side edge 24 to the second side edge 26 generally between about 8 inches and 16 inches and a depth from the front edge 20 to the back edge 22 generally between about 3 inches and 7 inches. The front edge 22 has an arcuate notch 28 therein that is substantially centered between the first 24 and second 26 side edges. The panel 12 has a pair of apertures 30 extending therethrough. Each of the apertures 30 is positioned generally adjacent to one of the first 24 and second 26 side edges and between the front 20 and back 22 edges. The notch 28 has a depth generally between about 2 inches and 4 inches and a width generally between 4 inches and 7 inches. The panel 12 comprises a resiliently elastic material which is preferably an elastomer.

Each of a pair of reinforcement rings 32 is attached to a peripheral edge of one of the openings 30. The rings 32 each have an inner surface that is threaded. A pair of elongated rods 34 is provided. Each of the rods 34 has a first end 36 and a second end 38. The first ends 36 are each pointed and an outer surface 40 of each of the rods 34 is threaded. The rods 34 each have a diameter adapted for threadably engaging with one of the rings 32. The rods 34 each have a height from the first end 36 to the second end 38 greater than 4 inches, preferably greater than 5 inches and more preferably greater than 6 inches. Each of a pair of handles 42 is attached to one of the second ends 38 of the rods 34. The handles 42 each include bars attached to the rods 34 at generally perpendicular angles so that the handles 42 provide sufficient leverage for the turning of the rods 34 in the rings 32.

In use, each of the rods 34 is extended through one of the rings 32 such that each of the first ends 36 of the rods 34 extends away from the bottom side 16 of the panel 12. The rods 34 are rotated so that they are threadably coupled to the rings 32. A rear foot 6 of a batter 5 is positioned beneath the panel 12 so that the ankle of the rear foot 6 is positioned in the notch 28. Each of the rods 34 is extended into a ground surface 7, on either side of the rear foot 6, so that lifting of the rear foot 6 from the ground surface 7 is restricted when the batter 5 swings at a pitch. The rings 32 allow the rods 34 to be selectively adjustable in terms of distance of extension away from the panel 12. This allows for variation of ground surfaces 7 into which the rods 34 are to be extended. Loose soil may require a greater distance from the first ends to the bottom surface while compact soil would require less distance. Aside from varying how firmly the panel 12 is to be attached to the ground surface, this also aids a user of the device 10 in ensuring that the bottom surface 16 is adjacent to the ground surface 7. By restricting the lifting of the rear foot 6 of a batter's stance, proper batting technique is taught, as the batter 5 will properly retain their rear foot 6 in a planted state.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of training a batter to retain a rear foot in a planted position, said method comprising the steps of:

providing a flexible panel having a top side, a bottom side and a peripheral edge, said peripheral edge including a front edge, a back edge, a first side edge and a second side edge, said front edge having an arcuate notch therein, said notch being substantially centered between said first and second side edges, said panel having a pair of apertures extending therethrough, each of said apertures being positioned generally adjacent to one of said first and second side edges and between said front and back edges;

providing a pair of reinforcement rings, each of said rings being attached to a peripheral edge of one of said openings;

providing a pair of elongated rods each having a first end and a second end, each of said first ends being pointed;

providing a pair of handles, each of said handles being attached to one of said second ends of said rods;

extending each of said rods through one of said rings such that each of said first ends of said rods extends away from said bottom side of said panel;

positioning a rear foot of the batter beneath said panel such that the ankle of the rear foot is positioned in the notch; and extending each of said first ends of said rods into a ground surface so that lifting of the rear foot from the ground surface is restricted when the batter swings at a pitch.

2. The method according to claim 1, wherein said panel has a width from said first side edge to said second side edge generally between 8 inches and 16 inches and a depth from said front edge to said back edge generally between 3 inches and 7 inches.

3. The method according to claim 2, wherein said notch has a depth generally between 2 inches and 4 inches and a width generally between 4 inches and 7 inches.

4. The method according to claim 3, wherein said panel comprises a resiliently elastic material.

5. The method according to claim 2, wherein each of said rings has an inner surface, each of said inner surfaces being threaded, and wherein an outer surface of each of said rods is threaded, each of said rods having a diameter adapted for threadably engaging with one of said rings, further including the step of threadably coupling said rods to said rings after said rods are extended into said rings.

6. The method according to claim 1, wherein said notch has a depth generally between 2 inches and 4 inches and a width generally between 4 inches and 7 inches.

7. The method according to claim 1, wherein said panel comprises a resiliently elastic material.

8. The method according to claim 6, wherein each of said rings has an inner surface, each of said inner surfaces being threaded, and wherein an outer surface of each of said rods is threaded, each of said rods having a diameter adapted for threadably engaging with one of said rings, further including the step of threadably coupling said rods to said rings after said rods are extended into said rings.

9. A method of training a batter to retain a rear foot in a planted position, said method comprising the steps of:

providing a flexible panel having a top side, a bottom side and a peripheral edge, said peripheral edge including a front edge, a back edge, a first side edge and a second side edge, said panel having a width from said first side edge to said second side edge generally between 8 inches and 16 inches and a depth from said front edge to said back edge generally between 3 inches and 7 inches, said front edge having an arcuate notch therein, said notch being substantially centered between said first and second side edges, said panel having a pair of apertures extending therethrough, each of said apertures being positioned generally adjacent to one of said first and second side edges and between said front and back edges, said notch having a depth generally between 2 inches and 4 inches and a width generally between 4 inches and 7 inches, said panel comprising a resiliently elastic material, said elastic material being an elastomer;

providing a pair of reinforcement rings, each of said rings being attached to a peripheral edge of one of said openings, each of said rings having an inner surface, each of said inner surfaces being threaded;

providing a pair of elongated rods each having a first end and a second end, each of said first ends being pointed, an outer surface of each of said rods being threaded, each of said rods having a diameter adapted for threadably engaging with one of said rings, each of said rods having a height from said first end to said second end greater than 4 inches;

providing a pair of handles, each of said handles being attached to one of said second ends of said rods;

extending each of said rods through one of said rings such that each of said first ends of said rods extends away from said bottom side of said panel;

threadably coupling said rods to said rings;

positioning a rear foot of the batter beneath said panel such that the ankle of the rear foot is positioned in the notch; and extending each of said first ends of said rods into a ground surface so that lifting of the rear foot from the ground surface is restricted when the batter swings at a pitch.

* * * * *